US008672568B2

(12) United States Patent
Okano et al.

(10) Patent No.: US 8,672,568 B2
(45) Date of Patent: Mar. 18, 2014

(54) PRINTING APPARATUS

(75) Inventors: Tetsuya Okano, Aichi (JP); Yoshifumi Kajikawa, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 58 days.

(21) Appl. No.: 13/292,684

(22) Filed: Nov. 9, 2011

(65) Prior Publication Data

US 2012/0134732 A1 May 31, 2012

(30) Foreign Application Priority Data

Nov. 29, 2010 (JP) ..... 2010-265736

(51) Int. Cl.
*B41J 11/50* (2006.01)

(52) U.S. Cl.
USPC ..... 400/607.2; 400/599

(58) Field of Classification Search
USPC ..... 400/607.1
See application file for complete search history.

(56) References Cited

U.S. PATENT DOCUMENTS

| | | | | |
|---|---|---|---|---|
| 5,008,715 | A | 4/1991 | Imaizumi et al. | |
| 5,463,457 | A | 10/1995 | Takeuchi et al. | |
| 5,730,535 | A * | 3/1998 | Keller et al. | 400/605 |
| 6,215,970 | B1 | 4/2001 | Yoshikawa et al. | |
| 7,636,543 | B2 * | 12/2009 | Mandel et al. | 399/407 |
| 7,862,032 | B2 | 1/2011 | Taniguchi | |
| 7,954,720 | B2 | 6/2011 | Kubota et al. | |
| 8,517,617 | B2 * | 8/2013 | Hashimoto | 400/582 |
| 2006/0127149 | A1 | 6/2006 | Togashi et al. | |
| 2006/0198676 | A1 * | 9/2006 | Kimura et al. | 399/401 |
| 2008/0156883 | A1 | 7/2008 | Kubota et al. | |
| 2009/0039591 | A1 | 2/2009 | Taniguchi | |
| 2009/0087237 | A1 | 4/2009 | Sato | |
| 2010/0021185 | A1 | 1/2010 | Okano | |
| 2010/0247193 | A1 * | 9/2010 | Suzuki | 399/364 |
| 2011/0068534 | A1 | 3/2011 | Taniguchi | |
| 2011/0097129 | A1 | 4/2011 | Hashimoto | |

FOREIGN PATENT DOCUMENTS

| | | | |
|---|---|---|---|
| CN | 101209628 | A | 7/2008 |
| CN | 101362561 | A | 2/2009 |
| JP | 06-089052 | A | 3/1994 |
| JP | 06-312549 | A | 11/1994 |

(Continued)

OTHER PUBLICATIONS

European Search Report and the Search Opinion issued EP Application No. 11186556.4 dated Dec. 17, 2012.

(Continued)

*Primary Examiner* — Anthony Nguyen
(74) *Attorney, Agent, or Firm* — Banner & Witcoff, Ltd.

(57) ABSTRACT

A printing apparatus is provided. The printing apparatus includes a printing unit, a sheet feeder, a discharge unit, a sheet path including a feeding path, a discharge path, and a reversing path, a manual sheet inlet and a manual sheet path for a manually-inserted recording sheet, a detecting unit to detect the manually-inserted recording sheet fed through the manual sheet inlet whilst a double-face printing operation is conducted with a preceding recording sheet, a judging unit to judge as to whether the detecting unit detected the manually-inserted recording sheet, and a conveyer controller unit to convey the preceding recording sheet in the double-face printing operation to the discharge unit without reversing when the judging unit judges that the detecting unit detected the manually-inserted recording sheet.

11 Claims, 9 Drawing Sheets

(56) References Cited

FOREIGN PATENT DOCUMENTS

| | | | |
|---|---|---|---|
| JP | 11-246078 | A | 9/1999 |
| JP | 2005-219860 | A | 8/2005 |
| JP | 2007-076782 | A | 3/2007 |
| JP | 2009-086506 | A | 4/2009 |
| JP | 2010-083625 | A | 4/2010 |
| JP | 2011-093160 | A | 5/2011 |

OTHER PUBLICATIONS

Notice of Allowance issued in Japanese Patent Application No. 2010-265736, issued on Jan. 8, 2013.

Office Action received in counterpart Chinese Application No. 201110354047.4, dated Nov. 26, 2013.

* cited by examiner

PRINTING APPARATUS

CROSS REFERENCE TO RELATED APPLICATION

This application claims priority from Japanese Patent Application No. 2010-265736, filed on Nov. 29, 2010, the entire subject matter of which is incorporated herein by reference.

BACKGROUND

1. Technical Field

An aspect of the present invention relates to a printing apparatus capable of printing images on either side of a recording sheet. More specifically, the present invention relates to a double-face printable printing apparatus having a sheet path, along which a recording sheet fed manually by a user is guided to a printing unit.

2. Related Art

A printing apparatus capable of "double-face printing," i.e., printing an image on an either or both sides of a recording sheet, is known. The printing apparatus may have a sheet-reversing path, in which the recording sheet with an image printed on one side is turned over, so that another image can be printed on the other side of the recording sheet. Meanwhile, a printing apparatus having a manual sheet path to convey a manually-fed recording sheet is known. Further, a printing apparatus, which has both of the double-face printing function and the manual sheet path, is known.

SUMMARY

In the printing apparatus with the double-face printing function and the manual sheet path, a recording sheet may be manually inserted in the manual sheet path by a user whilst the printing apparatus is conducting a double-face printing operation with a recording sheet having been loaded in the printing apparatus earlier. However, behaviors of the printing apparatus in such a case, in which the preceding recording sheet conveyed in the sheet-reversing path and the manually-inserted recording sheet may collide, are yet to be considered. For example, when the collision does occur, the collided recording sheets may be jammed inside the printing apparatus, and the user may be required to remove the collided recording sheets.

In view of such consideration, the present invention is advantageous in providing a printing apparatus, which reduces burden for the user when the recording sheet is manually inserted whilst the printing apparatus is in a double-face printing operation.

According to an aspect of the present invention, a printing apparatus, which is capable of double-face printing to print images on both sides of a recording sheet, is provided. The printing apparatus includes a printing unit, which is configured to print an image on one of the sides of the recording sheet, a sheet feeder, which is configured to feed the recording sheet to the printing unit, a discharge unit, in which the recording sheet with the image printed thereon is settled, a sheet path, which includes a feeding path to guide the recording sheet fed from the sheet feeder to the printing unit, a discharge path to guide the recording sheet passing through the printing unit to the discharge unit, and a reversing path diverging from the discharge path and merging into the feeding path at an upstream position with respect to the printing unit along a direction of conveying the recording sheet, the sheet path guiding the recording sheet therealong and reversing the recording sheet by use of the reversing path and reverse-conveyance during a double-face printing operation, a manual sheet inlet, through which a recording sheet is manually inserted in the printing apparatus by a user, a manual sheet path, which is configured to merge into the sheet path at a merging point being in an upstream position with respect to the printing unit along the direction of conveying the recording sheet and guide the manually-inserted recording sheet to the merging point, a detecting unit, which is configured to detect the manually-inserted recording sheet fed through the manual sheet inlet whilst the double-face printing operation is conducted with a preceding recording sheet, a judging unit, which is configured to judge as to whether the detecting unit detected the manually-inserted recording sheet, and a conveyer controller unit, which is configured to convey the preceding recording sheet in the double-face printing operation to the discharge unit without reversing when the judging unit judges that the detecting unit detected the manually-inserted recording sheet.

According to another aspect of the present invention, a printing apparatus, which is configured to print an image on a recording sheet, is provided. The printing apparatus includes a sheet storage, which is configured to store the recording sheet, a printing unit, which is configured to print an image on one of two sides of the recording sheet, a pick-up unit, which is configured to pick up the recording sheet from the sheet storage, a discharge unit, which is configured to discharge the recording sheet, a conveyer, which includes a first conveyer configured to convey the recording sheet picked up from the sheet storage by the pick-up unit to the printing unit, a second conveyer to convey the recording sheet passing through the printing unit to the discharge unit, and a reversing conveyer configured to diverge from the second conveyer and merge into the first conveyer at a first merging point, the conveyer conveying the recording sheet and reversing the recording sheet by use of the reversing conveyer during a double-face printing operation, a sheet inlet, which is configured to receive a different recording sheet inserted in the printing apparatus, a third conveyer, which is configured to merge into the first conveyer at a second merging point and to convey the different recording sheet from the sheet inlet to the second merging point, the second merging point being in a different position from the first merging point, a detector, which is configured to detect the different recording sheet being fed through the sheet inlet, and a conveyer controller, which is configured to control the conveyer to convey the recording sheet in the first conveyer to the discharge unit if the detector detects the different recording sheet being inserted into the sheet inlet while the first conveyer is conveying the recording sheet.

BRIEF DESCRIPTION OF THE ACCOMPANY DRAWINGS

DETAILED DESCRIPTION

Hereinafter, embodiments of the present invention will be described with reference to the accompanying drawings. A printer 100 is a printing apparatus, which has a double-face printing function and a manual sheet path for conveying a manually fed recording sheet.

Overall Configuration of Printer

Figure 1:
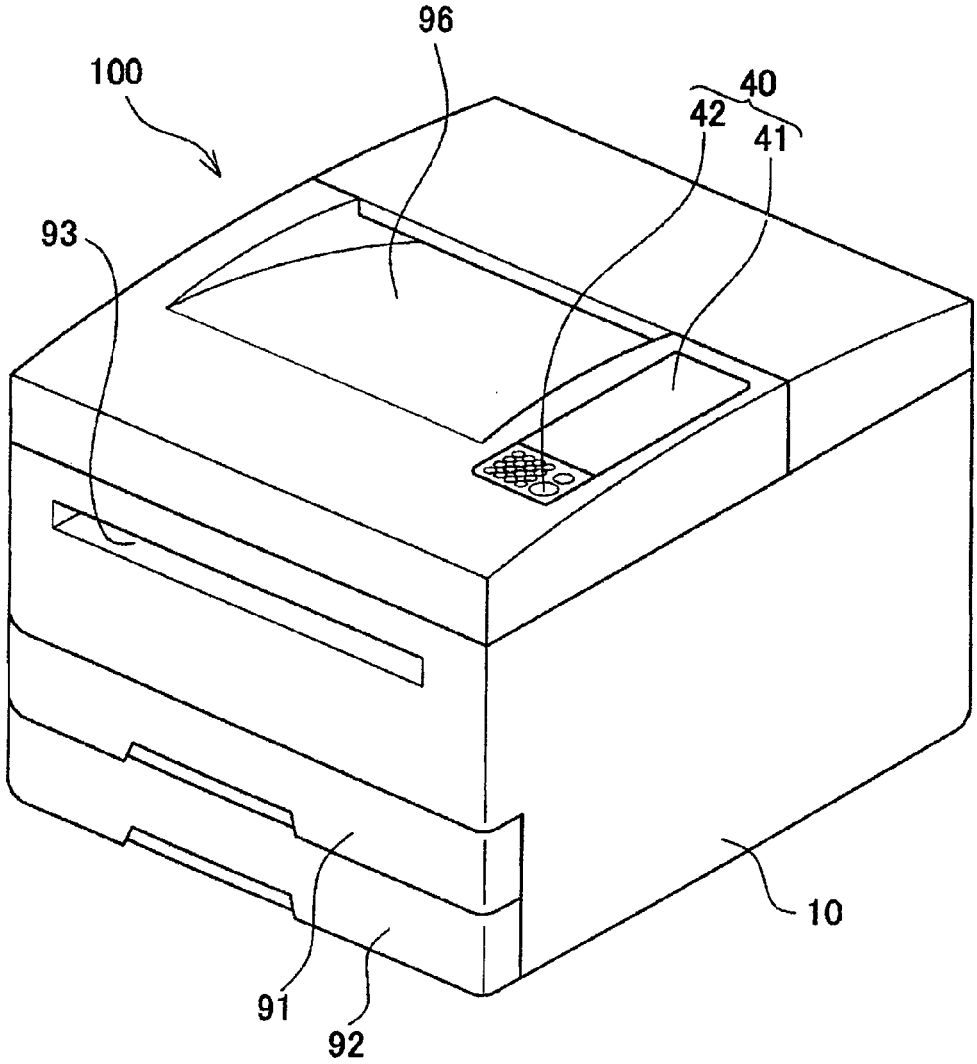
FIG. 1 is a perspective view of a printer according to an embodiment of the present invention.

The printer 100 (see FIG. 1) according to the present embodiment includes a main unit 10, which forms an image on a surface of a recording sheet, a display unit 41 including a liquid crystal display, and an operation panel 40, through which information concerning operations of the printer 100 is displayed and user's input is entered. The operation panel 40 includes buttons 42 such as a start key, a stop key, and numerical keys (not shown).

The main unit 10 is arranged in a lower section of the printer 100 and includes sheet cassettes 91, 92, a discharge tray 96, and a manual sheet inlet 93. The sheet cassettes 91, 92 are installable in and removable from the printer 100 and stores unused recording sheets therein. The discharge tray 96 is arranged in a top section of the printer 100. The recording sheets with images formed thereon are discharged out of the main unit 10 and settled in the discharge tray 96. The manual sheet inlet 93 is an opening, through which a user manually inserts the recording sheet in the main unit 10.

Internal Configuration of the Printer

Figure 2:
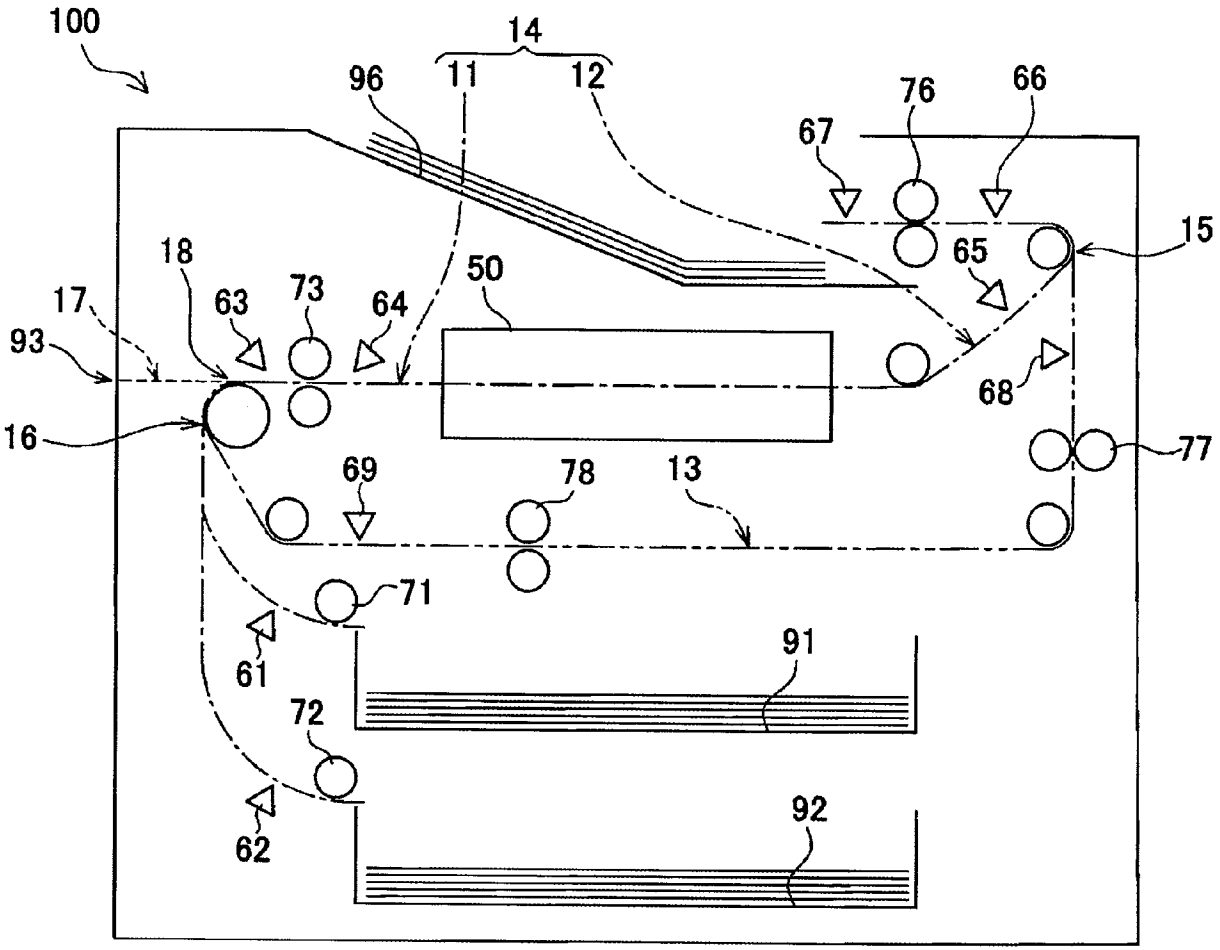
FIG. 2 is a schematic diagram to illustrate an internal configuration of the printer according to the embodiment of the present invention.

The printer 100 includes a processing unit 50 (see FIG. 2), which forms a toner image in a known electro-photographic laser-printing method and transfers the toner image onto a surface of the recording sheet. The processing unit 50 may or may not be a laser-printing unit but may be, for example, an inkjet-printing unit. Further, the printer 100 may or may not necessarily be a color printer but may be, for example, a monochrome printer.

The printer 100 includes feed rollers 71, 72, a register roller 73, and a discharge roller 76. The feed roller 71 picks up the recording sheets stored in the sheet cassette 91 one-by-one, and the feed roller 72 picks up the recording sheets stored in the sheet cassette 92 one-by-one. The register roller 73 conveys the recording sheet to the processing unit 50. The discharge roller 76 conveys the recording sheet to the discharge tray 96. Further, the printer 100 includes a plurality of conveyer rollers, including conveyer rollers 77, 78, along sheet paths. The discharge roller 76 is a bidirectional roller, which is rotatable in two different (normal and reverse) directions. The register roller 73, the conveyer rollers 77, 78 are unidirectional rollers, which are rotatable in a single (normal) direction.

In the printer 100, a feeding path 11, in which the recording sheet picked up from the sheet cassette 91/92 by the feed roller 71/72 is guided through the register roller 73 to the processing unit 50, are arranged. Further, in the printer 100, a discharge path 12, in which the recording sheet is guided from the processing unit 50 through the discharge roller 76 to the discharge tray 96, is arranged. The feeding path 11, from the sheet cassette 91/92 to the processing unit 50, and the discharge path 12, from the processing unit 50 to the discharge roller 76, is arranged to have a cross-sectional shape similar to a "U," and a printing path 14 including the feeding path 11 and the discharge path 12 has a cross-sectional shape similar to an "S." The printing path 14 is indicated in dash-and-dot lines in FIG. 2.

In the printer 100 according to the present embodiment, the recording sheets stored in the sheet cassette 91/92 are picked up one-by-one and fed in the feeding path 11. The recording sheets are conveyed to the processing unit 50, in which the toner image is transferred onto the surface of the recording sheet. The recording sheet with the transferred toner image is forwarded to a fixing device (not shown) in the processing unit 50, and the toner image is thermally fixed on the surface of the recording sheet. The recording sheet with the fixed image is carried in the discharge path 12 to the discharge roller 76, which ejects the recording sheet out of the main unit 10. The ejected recording sheet is settled in the discharge tray 96.

The printer 100 has a structure to turn over the recording sheet in order to print an image even on a reversed side of the recording sheet. More specifically, the printer 100 is capable of printing a first image on one side (a first side) of the recording sheet, turning over the recording sheet after the first image is printed on the first side, and printing a second image on the other side (a second side) of the same recording sheet. The recording sheet with the first image printed on the first side is turned over in a reversing path 13 and returned to the processing unit 50 with the second side facing the processing unit 50. The reversing path 13 is indicated in a double-dotted line in FIG. 2.

The reversing path 13 is arranged to diverge from the discharge path 12 at a branch point 15, which is in a lower-stream position with respect to the processing unit 50 and in an upper-steam position with respect to the discharge roller 76 along a direction of a flow of the recording sheet being conveyed. The reversing path 13 diverged from the branch point 15 extends in a position between the processing unit and the sheet cassette 91 and merges into the printing path 14 at a merging point 16, which is in a lower-stream position with respect to the feed rollers 71, 72 in the feeding paths 11 and in an upper-stream position with respect to the register roller 73. Thus, paths for the recording sheet in the printer 100 include the printing path 14 and the reversing path 13.

A flow of the recording sheet being conveyed in the printer 100 during a double-face printing operation will be described below. In the following description, it is to be noted that a front end and a rear end of the recording sheet are referred to with reference to direction of conveying the recording sheet. Therefore, the front end and the rear end replace each other when the directions of conveying the recording sheet are switched from normal to reverse, and vice versa. Firstly, the recording sheet being picked up from the sheet tray 91/92 is carried in the feeding path 11 to the processing unit 50. The first image is formed on the first side of the recording sheet in the processing unit 50. Secondly, the recording sheet with the first image printed on the first side is carried in the discharge path 12 to the discharge roller 76. Thirdly, when the recording sheet reaches the discharge roller 76 and a rear end of the recording sheet passes through the branch point 15, rotation of the discharge roller 76 in a normal direction is stopped with the recording sheet being nipped between the discharge roller 76 and a paired roller (unsigned). Fourthly, a rotating direction of the discharge roller 76 is switched, and the discharge roller 76 rotates in a reversing direction. Fifthly, according to the reverse rotation of the discharge roller 76, the recording sheet is conveyed in the reversing direction in the reversing path 13 via the branch point 15. After the recording sheet is conveyed in the reversing path 13, the rotating direction of the discharge roller 76 is switched in the normal direction. Sixthly, the recording sheet is returned to the feeding path 11 via the merging point 16, which is in the upper-stream position with respect to the processing unit 50. Thus, the recording sheet is turned over to have the second side facing the processing unit 50 when the recording sheet is carried to the processing unit 50. Seventhly, the second image is printed on the second side of the recording sheet in the processing unit 50. Finally, the recording sheet with the second image printed on the second side is discharged by the discharge roller 76 and settled in the discharge tray 96.

The printer 100 is further provided with a structure for manual sheet-feeding, which conveys a recording sheet manually fed by a user in a manual sheet path 17 in the printer 100. The manual sheet path 17, indicated in a broken line in FIG. 2, guides the manually-inserted recording sheet through the manual sheet inlet 93 to the feeding path 11 via a merging point 18. That is, the manual sheet path 17 ranges from the manual sheet inlet 93, which is a most upstream point, to the merging point 18, which is a most downstream point. The merging point 18 is in an upper-stream position with respect to the register roller 73 and a lower-stream position with respect to the feed rollers 71, 72 in the feeding path 11. The merging point 18 is in a position apart from the merging point 16. In the present embodiment, the merging point 16 is in an upper-stream position with respect to the merging point 18 in the feeding path 11. When, for example, the merging point 16 and the merging point 18 are in a same position in the feeding path 11, configuration surrounding the merging points 16, 18 including sheet-guiding structures for the recording sheets may become complicated, and the complicated structures may prevent the recording sheets from being conveyed smoothly and cause sheet jams. Therefore, the merging points 16, 18 are arranged in different positions from each other.

A flow of the manually-inserted recording sheet being conveyed in the printer 100 during a printing operation will be described below. Firstly, the recording sheet is inserted through the manual sheet inlet 93 by the user. The manually-inserted recording sheet is forwarded by the user along the manual sheet path 17 to the feeding path 11. When the manually-inserted recording sheet reaches the register roller 73, the register roller 73 nips the manually-inserted recording sheet in cooperation with a paired roller (unsigned) and stands by. Secondly, when the processing unit 50 is prepared for printing an image, the register roller 73 is rotated, and the manually-inserted recording sheet is carried in the feeding path 11 to be automatically drawn in the printer 100. Thirdly, when the manually-inserted recording sheet reaches the processing unit 50, the image is printed on a surface of the manually-inserted recording sheet in the processing unit 50. Thus, until the register roller 73 nips the manually-inserted recording sheet, the user holds and forwards the manually-inserted recording sheet in the manual sheet path 17. Once the register roller 73 nips the manually-inserted recording sheet, the manually-inserted recording sheet is automatically carried in the feeding path 11. It is to be noted that images may be formed on the first and second sides of the manually-inserted recording sheet, similarly to the recording sheet fed from the sheet cassette 91, 92, once the manually-inserted recording sheet is drawn automatically in the printer 100.

The printer 100 includes sheet sensors 61-69, which are arranged along the sheet paths 13, 14, 17. The sheet sensors 61-64 are arranged along the feeding path 11. More specifically, the sheet sensor 61 and the sheet sensor 62 are arranged in immediate downstream positions with respect to the feed roller 71 and the feed roller 72 respectively. The sheet sensor 63 is arranged in an immediate upstream position with respect to the register roller 73, and the sheet sensor 64 is arranged in an immediate downstream position with respect to the register roller 73. The sheet sensors 65-67 are arranged along the discharge path 12. More specifically, the sheet sensor 65 is arranged in an immediate upstream position with respect to the branch point 15, the sheet sensor 66 is arranged in an immediate downstream position with respect to the branch point 15 with reference to the flow of the recording sheet being conveyed in the normal direction. The sheet sensor 67 is arranged in an immediate downstream position with respect to the discharge roller 76 with reference to the flow of the recording sheet being carried in the normal direction. Further, the sheet sensors 68, 69 are arranged along the reversing path 13. More specifically, the sheet sensor 68 is arranged in an immediate upstream position with respect to the conveyer roller 77, which is in a position closest to the branch point 15 amongst the plurality of conveyer rollers 77, 78. The sheet sensor 69 is arranged in a lower-stream position with respect to the sheet sensor 68 with reference to the flow of the recording sheet being conveyed in the reversing path 13.

Each of the sheet sensors 61-69 detects presence of the recording sheet entering a detectable range thereof and changes output signals when the recording sheet entering the detectable range is detected. Therefore, when the signals from the sheet sensors 61-69 change, that is, when signals indicating absence of the recording sheet are switched to signals indicating presence of the recording sheet, a front end of the recording sheet reaching the detectable range is detected. When the signals indicating presence of the recording sheet are switched to the signals indicating absence of the recording sheet, the rear end of the recording sheet passing through and exiting the detectable range is detected.

Additionally to detection of the front end of the recording sheet, signals output from the sheet sensors 61, 62 can be referred to in order to detect a length of the recording sheet being carried in the feeding path 11. The length of the recording sheet may be obtained, for example, based on a length of a time period between detection of the front end and detection of the rear end of the recording sheet at the sheet sensor 61 and a speed to carry the recording sheet, which is obtained based on a rotation speed of the feed roller 71.

The sheet sensor 63 can detect the manually-inserted recording sheet having been inserted in the manual sheet path 17 at the earliest amongst the sheet sensors 61-69. Therefore, signals output from the sheet sensor 63 can be referred to in order to detect the manually-inserted recording sheet having been inserted. The sheet sensor 63 may be referred to as a "pre-register sensor 63" hereinbelow. Meanwhile, signals output from the sheet sensor 64 can be used to determine timings to start feeding the recording sheet to the processing unit 50 and to start forming an image in the processing unit 50. The sheet sensor 64 may be referred to as a "post-register sensor 64" hereinbelow.

It is to be noted that a quantity and arrangement of the sheet sensor are not limited to those described above but may be modified arbitrarily. For example, a greater quantity of the sheet sensors may enable to detect an accurate position of a sheet jam, when occurs, in the sheet paths. For example, on the other hand, a smaller quantity of the sheet sensors may enable manufacturing cost for the printers to be reduced.

Electrical Configuration of the Printer

Figure 3:
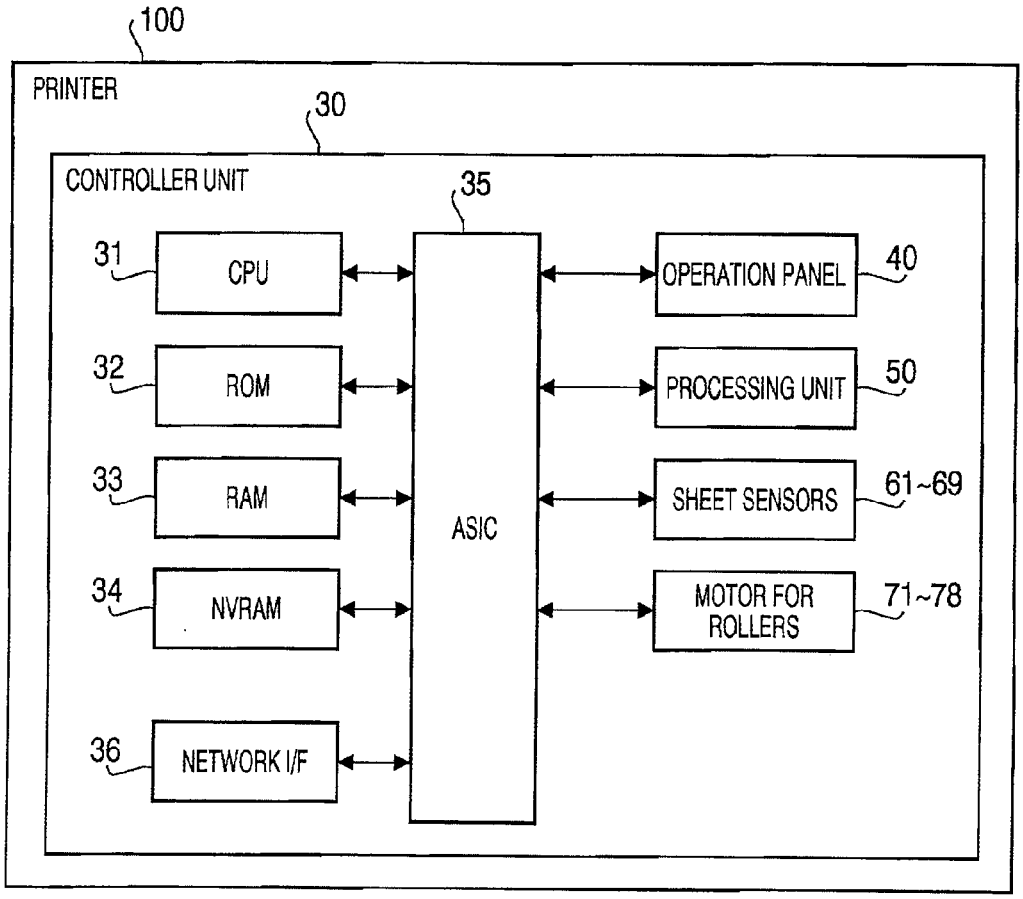
FIG. 3 is a block diagram to illustrate an electrical configuration of the printer according to the embodiment of the present invention.

The electrical configuration of the printer 100 will be described (see FIG. 3). The printer 100 is provided with a controller unit 30, which includes a CPU 31, a ROM 32, a RAM 33, a non-volatile RAM (NVRAM) 34, an ASIC 35, and a network interface (I/F) 36. The controller unit 30 is electrically connected with the processing unit 50, the operation panels 40, the sheet sensors 61-69, and a motor to drive the rollers 71-78. The rollers 71-78 may be driven commonly by a motor. Alternatively, a plurality of motors may be provided, and the rollers 71-78 may be driven individually.

The CPU 31 is an arithmetic processor, which processes information to be used to achieve functionalities of the printer 100 including image forming. The ROM 32 stores programs to control the printer 100 and information concerning operation settings and initial settings of the printer 100. The RAM 33 serves as a work area, in which the controlling programs are loaded, and a memory area, in which image data is temporarily stored. The NVRAM 34 is a data storage, in which information concerning operation settings and image data can be stored.

The CPU 31 controls behaviors of the printer 100 through the ASIC 35. In particular, the CPU 31 processes information from the controlling programs and signals obtained from various sensors and stores the information in the RAM 33 and the NVRAM 34 to drive components in the printer 100. The CPU 31 controls, for example, timing for emitting light from an exposure device, and activation of the motor to drive the rollers 71-78.

The network I/F 36 connects the printer 100 with networks, such as a local area network (LAN), to establish communication with other external devices (e.g., personal computer) through the network. The printer 100 can be supplied with print jobs through the network I/F 36.

Double-Face Printing Operation

Behaviors of the printer 100 in a double-face printing operation according to a first embodiment of the present invention will be described with reference to flowcharts shown in FIGS. 4, 5, and 6. The flows of double-face printing operation may be controlled and executed by the controller unit 30 upon, for example, receipt of a print job for double-face printing, which is transmitted from an external device. In the print job described below, images are formed on a recording sheet supplied from the sheet cassette 91; however, a recording sheet supplied from the sheet cassette 92 or other additional sheet cassette (not shown) may be similarly handled in the printer 100.

Figure 4:
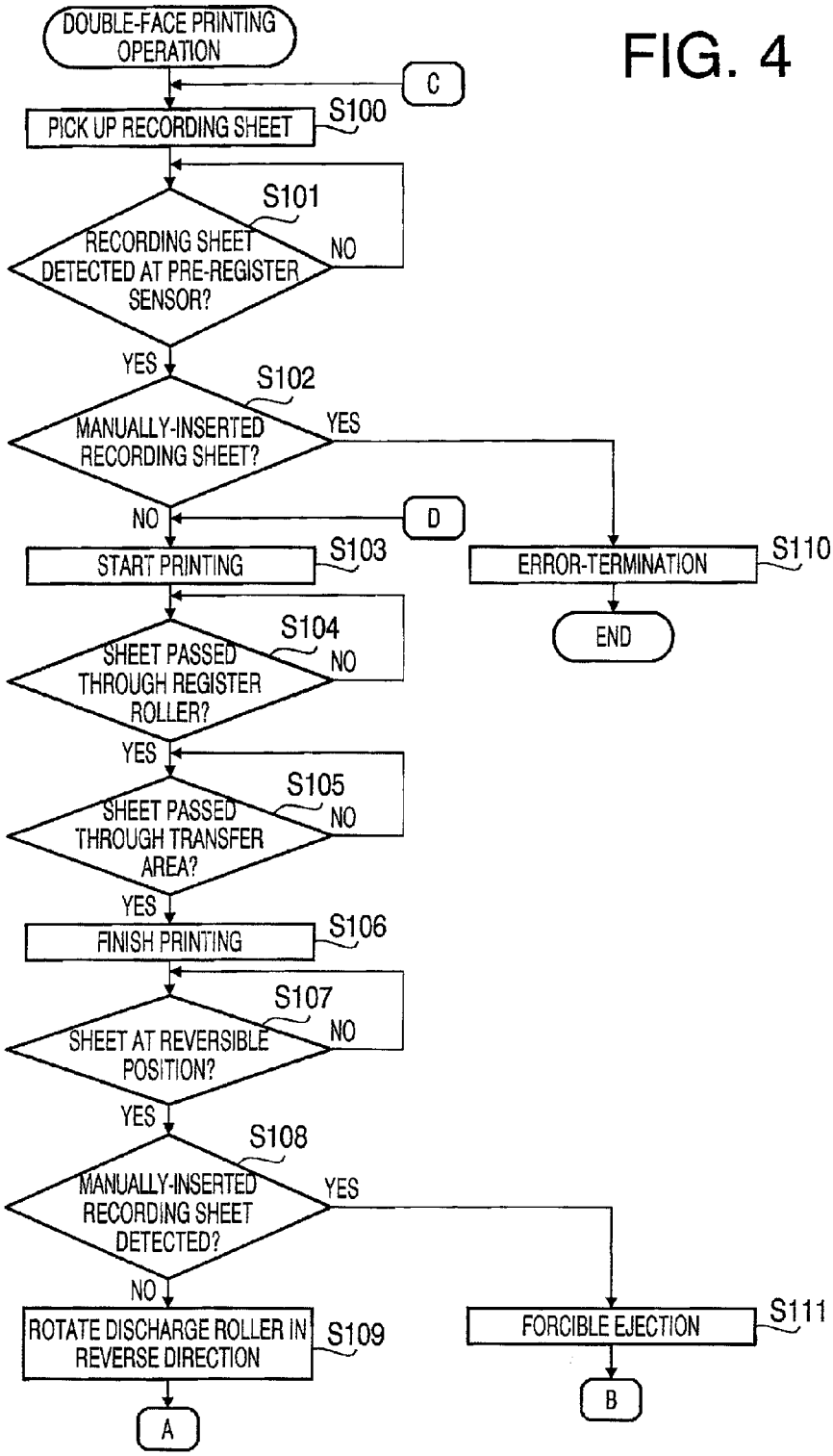
FIG. 4 is a first part of a flow of a double-face printing operation to be conducted in the printer according to the embodiment of the present invention.

As shown in FIG. 4, when the double-face printing operation starts, in S100, a recording sheet is picked up from the sheet cassette 91. In S101, it is determined as to whether a recording sheet reached the detectable range for the pre-register sensor 63 based on the signals output from the pre-register sensor 63. In other words, it is determined as to whether the pre-register sensor 63 detected a front end of a recording sheet. If no recording sheet is detected (S101: NO), the flow repeats S101 until the pre-register sensor 63 detects the recording sheet.

If a recording sheet is detected by the pre-register sensor 63 (S101: YES), in S102, it is judged as to whether the recording sheet is a manually-inserted recording sheet. If a front end of a recording sheet is detected by the pre-register sensor 63 prior to an estimated timing, at which the recording sheet picked up from the sheet cassette 91 is expected to reach the detectable range of the pre-register sensor 63 based on the speed to convey the recording sheet, it is determined that the recording sheet detected by the pre-register sensor 63 is a manually-inserted recording sheet, which is carried via a sheet path other than the feeding path 11, i.e., the manual sheet path 17. For example, if the pre-register sensor 63 detects a front end of a recording sheet after the sheet sensor 61 detected a front end of a recording sheet and before a predetermined period elapses, it is determined that the recording sheet detected by the pre-register sensor 63 is a manually-inserted recording sheet.

If the detected recording sheet is a manually-inserted recording sheet (S102: YES), the manually-inserted recording sheet may collide with the preceding recording sheet, which was picked up from the sheet cassette 91 in S100. Therefore, in S110, conveyance of the recording sheets is terminated ("error-termination"), and the double-face printing operation is aborted. When the double-face printing operation is error-terminated, the preceding recording sheet and the manually-inserted recording sheet are required to be removed by a user. If the recording sheet detected by the pre-register sensor 63 is not a manually-inserted recording sheet, that is, the detected recording sheet is the recording sheet picked up in S100 (S102: NO), in S103, printing an image on a first side of the recording sheet starts.

Following S103, in S104, it is judged as to whether the recording sheet with the image printed on the first side thereof passed through the register roller 73. In other words, it is judged as to whether a predetermined time period elapsed after a rear end of the recording sheet was detected by the pre-register sensor 63. If the recording sheet has not passed through the register roller 73 (S104: NO), the flow repeats S104 until the recording sheet passes through the register roller 73.

If the recording sheet has passed through the register roller 73 (S104: YES), in S105, it is judged as to whether the recording sheet has passed through a transfer area in the processing unit 50, in which the toner image is transferred onto a surface of the recording sheet. In other words, it is judged as to whether a predetermined time period elapsed after the post-register sensor 64 detected the rear end of the recording sheet. If the recording sheet has not passed through the transfer area (S105: NO), the flow repeats S105 until the recording sheet passes through the transfer area. If the recording sheet has passed through the transfer area (S105: YES), in S106, printing the image on the first side of the recording sheet is finished.

In S107, it is judged as to whether the recording sheet reached a reversible position, in which the recording sheet is nipped by the discharge roller 76, and the rear end of the recording sheet has passed through the branch point 15. In the reversible position, therefore, the direction of conveying the recording sheet can be switched, and the recording sheet starts being turned over to a reversed orientation. For example, it may be determined that the rear end of the recording sheet has passed through the branch point 15 if a predetermined time period elapsed after the rear end of the recording sheet was detected by the sheet sensor 65. If the recording sheet has not passed through the branch point 15 (S107: NO), the flow repeats S107 until the recording sheet reaches the reversible position.

If the recording sheet reached the reversible position (S107: YES), conveyance of the recording sheet is stopped, and in S108, it is judged as to whether a manually-inserted recording sheet is detected. For example, when the pre-register sensor 63 detects a recording sheet after the recording sheet passed through the register roller 73 and before the recording sheet is reversed, it is determined that the recording sheet detected by the pre-register sensor 63 is a manually-inserted recording sheet.

In S108, if a manually-inserted recording sheet is detected (S108: YES), in S111, the preceding recording sheet in the reversible position, which has been carried in the printing path 14 but not yet been discharged, is forcibly ejected without being carried to the reversing path 13. In the meantime, the manually-inserted recording sheet is maintained nipped by the register roller 73. The flow proceeds to S151 (see FIG. 6). The flow following S151 will be described later in detail.

Meanwhile, in S108, if no manually-inserted recording sheet is detected (S108: NO), in S109, the discharge roller 76 is rotated in the reversing direction. Accordingly, the recording sheet in the reversible position is carried in the reversing direction and directed to the reversing path 13.

Following S109, in S120 (FIG. 5), it is judged as to whether the preceding recording has reached a reverse cancellable point. The reverse cancellable point is a last position in a reverse cancellable range, in which the recording sheet once started being conveyed in the reversing direction can be again conveyed in the normal direction to be ejected out of the printer 100. Beyond the reverse cancellable point, the direction to convey the reversed recording sheet (i.e., the reversing direction) cannot be switched back to the normal direction. In other words, until the recording sheet goes beyond the reverse cancellable point, the recording sheet once being conveyed in the reversing direction can be again conveyed in the normal direction. In the present embodiment, the reverse cancellable point is set in a position, in which the recording sheet being carried in the reversing path 13 in the reversing direction is close to but not yet nipped by the conveyer roller 77. This is due to difficulty of conveying the recording sheet in the normal direction once the recording sheet is nipped by the conveyer roller 77, which is rotatable solely in the reversing direction. Determination that the recording sheet has reached the reverse cancellable point can be made when a predetermined time period elapsed after the sheet sensor 68 detected the front end of the recording sheet. If the recording sheet has not reached the reverse cancellable point (S120: NO), the flow repeats S120 until the recording sheet reaches the reverse cancellable point.

If the recording sheet has reached the reverse cancellable point (S120: YES), in S121, it is judged as to whether a manually-inserted recording sheet is detected. For example, when the pre-register sensor 63 detects a recording sheet after the direction to convey the preceding recording sheet was switched into the reversing direction and before the preceding recording sheet is carried beyond the reverse cancellable point, i.e., before reverse-conveyance of the preceding recording sheet becomes non-cancellable, it is determined that the recording sheet detected by the pre-register sensor 63 is a manually-inserted recording sheet.

In S121, if a manually-inserted recording sheet is detected (S121: YES), in S130, reverse-conveyance of the preceding recording sheet, which is not yet nipped by the conveyer roller 77, in the reverse cancellable range is cancelled, and the discharge roller 76 is rotated in the normal direction. In S131, the preceding recording sheet is ejected and settled in the discharge tray 96. In the meantime, the manually-inserted recording sheet is maintained nipped by the register roller 73. The flow proceeds to S151 (see FIG. 6). The flow following S151 will be described later in detail.

If no manually-inserted recording sheet is detected (S121: NO), in S122, it is judged as to whether the preceding recording sheet is released from the discharge roller 76. Release of the recording sheet from the discharge roller 76 may be determined, for example, when a predetermined time period elapsed after the sheet sensor 67 detected the rear end of the recording sheet. If the recording sheet is not released from the discharge roller 76 (S122: NO), the flow repeats S122 until the recording sheet is released from the discharge roller 76. If the recording sheet is released from the discharge roller 76 (S122: YES), in S123, rotation of the discharge roller 76 is switched in order for the discharge roller 76 to start rotating in the normal direction. The recording sheet is conveyed in the reversing path 13 and returns to the feeding path 11.

In S124, it is judged as to whether the pre-register sensor 63 detects a front end of a recording sheet. If no recording sheet is detected by the pre-register sensor 63 (S124: NO), the flow repeats S124 until a recording sheet is detected by the pre-register sensor 63.

If the recording sheet is detected by the pre-register sensor 63 (S124: YES), in S125, it is judged as to whether the detected recording sheet is a manually-inserted recording sheet. If a front end of a recording sheet is detected by the pre-register sensor 63 prior to an estimated timing, at which the recording sheet returning via the reversing path 13 to the feeding path 11 is expected to reach the detectable range of the pre-register sensor 63 based on the speed to convey the recording sheet, it is determined that the recording sheet detected by the pre-register sensor 63 is a manually-inserted recording sheet, which is carried via a sheet path other than the feeding path 11, i.e., the manual sheet path 17. If the recording sheet detected by the pre-register sensor 63 is determined to be a manually-inserted recording sheet (S125: YES), the preceding recording sheet returning via the reversing path 13 to the feeding path 11 may collide with the manually-inserted recording sheet when the preceding recording sheet is carried in the feeding path 11. Therefore, in S140, conveyance of the recording sheets is error-terminated, and the double-face printing operation is aborted.

If the recording sheet detected by the pre-register sensor 63 is not a manually-inserted recording sheet, that is, if the detected recording sheet is the preceding recording sheet returning via the reversing path 13 to the feeding path 11, in S126, printing an image on a second side of the recording sheet in the feeding path 11 starts. In S127, it is judged as to whether the recording sheet has passed through the transfer area in the processing unit 50. In other words, it is judged as to whether the predetermined time period elapsed after the post-register sensor 64 detected the rear end of the recording sheet. If the recording sheet has not passed through the transfer area (S127: NO), the flow repeats S127 until the recording sheet passes through the transfer area.

If the recording sheet has passed through the transfer area (S127: YES), in S128, printing the image on the second side of the recording sheet is finished. Thus, the double-face printing operation is completed.

Next, flows of a continuing action, which follows the forcible ejection of the preceding recording sheet in S111 (see FIG. 4) or in S131 (see FIG. 5) will be described hereinbelow with reference to FIG. 6.

Figure 7:
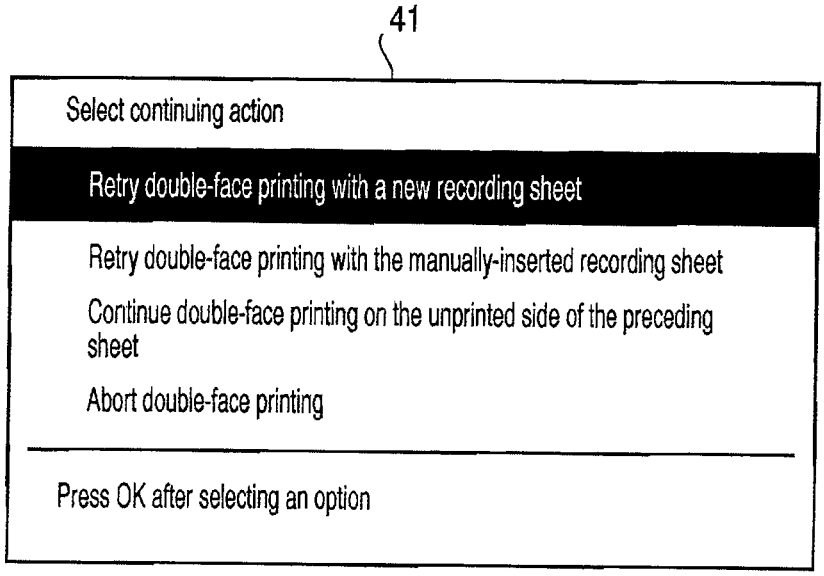
FIG. 7 is an illustrative view of a user interface window, through which an option for a continuing action after forcible ejection of a recording sheet is entered, in the printer according to the embodiments of the present invention.

In S151, a message to notify the user of the forcible ejection of the preceding sheet is displayed via the display unit 41. When the user's confirmation concerning the forcible ejection is entered, for example, via the OK button, in S152, a dialogue window (see FIG. 7), which presents options for a continuing action following the forcible ejection to the user, is displayed in the display unit 41. The user may enter one of the options through the dialogue window to select the continuing action.

The options for the continuing action may include retrying the double-face printing operation with a new recording sheet; retrying the double-face printing operation with the manually-inserted recording sheet; continuing the double-face printing operation to print an image on the unprinted (second) side of the forcibly-ejected preceding recording sheet ("manual double-face printing"); and aborting the double-face printing operation ("cancel").

If the user selects to retry the double-face printing operation with a new recording sheet or to continue printing on the unprinted side of the forcibly-ejected recording sheet, a notice to remove the manually-inserted recording sheet detected in one of S108 and S121 is presented to the user. The notice may be, for example, a text message displayed in the display unit 41 and/or a voice instruction. If the user selects to continue printing on the second side of the forcibly-ejected preceding recording sheet, a notice to insert the forcibly-ejected preceding recording sheet through the manual sheet inlet 93 with the unprinted second side facing upward is presented to the user. Again, the notice may be a text message and/or a voice instruction.

In S153, it is judged as to whether the entered user's selection for the continuing action is to abort the double-face printing operation. If the user's selection is not aborting the double-face printing operation (S153: NO), in S154, it is judged as to whether the entered user's selection is to retry the double-face printing operation with a new recording sheet. If the user's selection is not retrying the double-face printing operation with a new recording sheet (S154: NO), in S155, it is judged as to whether the entered user's selection is to retry the double-face printing operation with the manually-inserted recording sheet. If the user's selection is not retrying the double-face printing operation with the manually-inserted recording sheet (S155: NO), in S156, it is judged as to whether the entered user's selection is to continue the double-face printing operation to print on the unprinted second side of the forcibly-ejected preceding recording sheet. If the user's selection is not continuing the double-face printing operation to print on the unprinted second side of the forcibly-ejected preceding recording sheet (S156: NO), the flow returns to S153 and waits for the user's selection to be entered.

In S153, if the user's selection is aborting the double-face printing operation (S153: YES), the double-face printing operation is terminated. In this regard, the print job for the double-face printing operation stored in a memory area (not shown) in the printer 100 is cleared therefrom. Meanwhile, the user may remove the manually-inserted recording sheet (see S108 in FIG. 4 or S121 in FIG. 5), which is left nipped by the register roller 73.

In S154, if the user's selection is retrying the double-face printing operation with a new recording sheet (S154: YES), a new recording sheet is picked up from the sheet cassette 91/92. In this regard, however, it is assumed that the newly-picked recording sheet may collide with the manually-inserted recording sheet (see S108 in FIG. 4 or S121 in FIG. 5) being left nipped by the register roller 73. Therefore, in S161, it is judged as to whether the manually-inserted recording sheet has been removed by the user. Removal or presence of the manually-inserted recording sheet can be determined based on the signals from the pre-register sensor 63. If the manually-inserted recording sheet has been removed (S161: YES), the flow returns to S100 (see FIG. 4), and the double-face printing operation is performed with the newly-picked recording sheet to print the first and the second images on the first and second sides of the newly-picked recording sheet. In S161, if the manually-inserted recording sheet has not been removed but is left nipped by the register roller 73 (S161: NO), in S162, it is judged as to whether a timeout period elapsed. If the timeout period has not elapsed (S162: NO), the flow returns to and repeats S161 until the manually-inserted recording sheet is removed or the timeout period elapses. Once the timeout period elapses (S162: YES), in S163, the manually-inserted recording sheet nipped by the register roller 73 is drawn in and through the main unit 10 and directed along the printing path 14 to be forcibly ejected out of the printer 100. The ejected manually-inserted recording sheet is settled in the discharge tray 96. The flow returns to S100 (see FIG. 4).

In S155, if the user's selection is retrying the double-face printing operation with the manually-inserted recording sheet (S155: YES), the flow returns to S103 (see FIG. 4). In S103, the manually-inserted recording sheet detected in one of S108 and S121 is drawn in the main unit 10, and the double-face printing operation is performed with the manually-inserted recording sheet to print the first and the second images on the first and second sides of the manually-inserted recording sheet.

In S156, if the user's selection is continuing the double-face printing operation to print on the unprinted second side of the forcibly-ejected preceding recording sheet (S156: YES), the once forcibly-ejected preceding recording sheet is inserted through the manual sheet inlet 93. In this regard, however, the forcibly-ejected preceding recording sheet would collide with the manually-inserted recording sheet being left nipped by the register roller 73. Therefore, in S171, it is judged as to whether the manually-inserted recording sheet has been removed by the user. Again, removal or presence of the manually-inserted recording sheet can be determined based on the signals from the pre-register sensor 63. In S171, if the manually-inserted recording sheet has not been removed but is left nipped by the register roller 73 (S171: NO), the flow repeats S171 and waits until the manually-inserted recording sheet is removed. Optionally, the flow may repeat S171 until a predetermined timeout period elapses. After the timeout period has elapsed, the manually-inserted recording sheet may be drawn in and through the main unit 10 and directed along the printing path 14 to be forcibly ejected out of the printer 100.

If the manually-inserted recording sheet has been removed (S171: YES), in S172, it is judges as to whether the once forcibly-ejected recording sheet is manually inserted through the manual sheet inlet 93. Presence of the manually-inserted recording sheet inserted through the manual sheet inlet 93 may be determined based on the signals from the pre-register sensor 63. If no manually-inserted recording sheet is detected (S172: NO), the flow repeats S172 until a manually-inserted recording sheet is detected. When the manually-inserted recording sheet is detected (S172: YES), the flow returns to S126 (see FIG. 5). In S126, the double-face printing operation is resumed. Thus, the second image, which was initially intended to be printed on the second side of the preceding recording sheet, is printed on the second side of the once forcibly-ejected preceding recording sheet, which is now a manually-inserted recording sheet.

Figure 6:
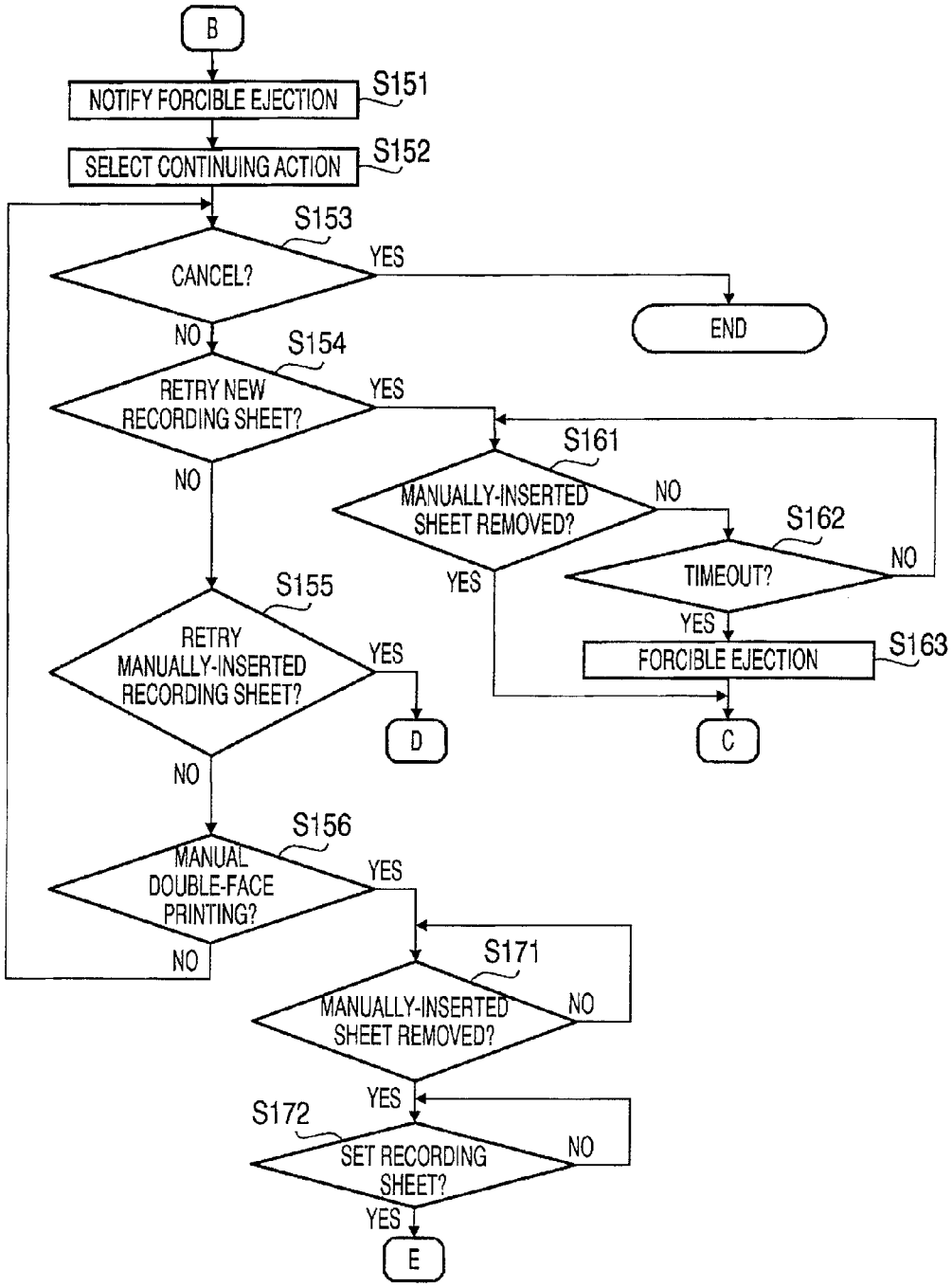
FIG. 6 is a third part of the flow of the double-face printing operation to be conducted in the printer according to the embodiment of the present invention.

In the flow described above, the continuing action can be selectable amongst four options in S152 (see FIG. 6). However, the flow may not necessarily provide the user with four options, but at least one continuing action may be executed after the forcible ejection of the preceding recording sheet. When no other option is prepared but the one continuing action is executed, display of the dialogue window to show the continuing action may be omitted.

According to the double-face printing operation as described above, when a manually-inserted recording sheet is detected during the predetermined time range, the preceding recording sheet is forcibly ejected, and the collision between the preceding recording sheet and the manually-inserted recording sheet can be avoided. Accordingly, errors due to collision of the preceding recording sheet with the manually-inserted recording sheet can be avoided, and the user's manual works such as removing the jammed sheets can be reduced. Further, the user is prompted to select the continuing action in the flow shown in FIG. 6. When one of retrying the double-face printing operation with a new recording sheet, retrying the double-face printing operation with the manually-inserted recording sheet, and a manual double-face printing operation is selected, the double-face printing operation is continued. Therefore, when a manually-inserted recording sheet is detected during the double-face printing operation, the double-face printing operation may not necessarily be error-terminated but may be continued if the manually-inserted recording sheet is detected in the predetermined time range.

The predetermined time range according to the present embodiment is from start of the double-face printing operation and until the preceding recording sheet starts being reversed. More specifically, the predetermined time range is from a point, at which the rear end of the preceding recording sheet passes through the merging point 18, and before the preceding recording sheet reaches the reversible position. Further, even after the preceding recording sheet reached the reversible position, and the direction to convey the preceding recording sheet started being reversed, the predetermined time range is extended until the preceding recording sheet is conveyed beyond the reverse cancellable point, beyond which the direction to convey the reversed recording sheet cannot be switched back to the normal direction.

Figure 8:
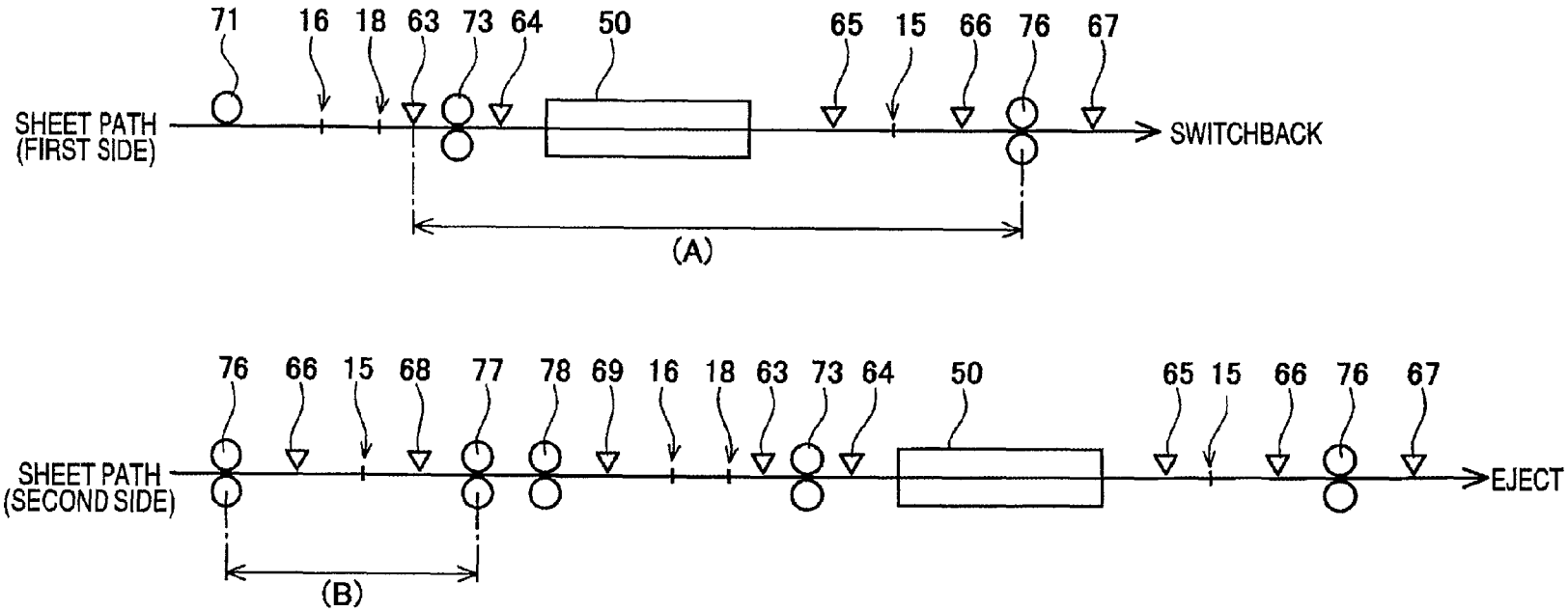
FIG. 8 is a diagram to illustrate behaviors of the manually-inserted recording sheet in a sheet path during the double-face printing operation in the printer according to the embodiment of the present invention.

The flow of the recording sheet in the double-face printing operation in the printer 100 according to the present embodiment along with the predetermined time range, in which the preceding recording sheet can be forcibly ejected, is shown in FIG. 8. As shown in FIG. 8, the predetermined time range includes a period A and a period B. The period A starts when the rear end of the preceding recording sheet passes through the pre-register sensor 63 and ends when the rear end of the preceding recording sheet passes through the merging point 15. The period B starts when reverse conveyance of the preceding recording sheet starts and ends when the front end of the preceding recording sheet reaches the conveyer roller 77. Therefore, during the double-face printing operation, sheet jam between the preceding recording sheet and the manually-inserted recording sheet may be avoided within the period A and the period B.

As has been described above, the printer 100 according to the embodiment of the present invention forcibly ejects the preceding recording sheet without forwarding to the reversing direction when a manually-inserted recording sheet is detected during a double-face printing operation and if the preceding recording sheet is not yet reversed. Accordingly, errors due to collision of the preceding recording sheet with the manually-inserted recording sheet can be avoided, and the user's manual works such as removing the jammed sheets can be reduced.

According to the above configuration, the double-face printing operation may not necessarily be aborted but may be continued with the recording sheet fed through the manual sheet inlet 93 after the preceding recording sheet is ejected.

According to the above configuration, the double-face printing operation may be continued with the preceding recording sheet, which is once ejected to the discharge unit 96. Therefore, the image printed on the one side of the preceding recording sheet can be avoided from being wasted.

According to the above configuration, the double-face printing operation may be continued with the manually-inserted recording sheet, which was detected by the pre-register sensor 63. Therefore, even after the double-face printing operation with the preceding recording sheet is aborted, the images can be achieved by the manually-inserted recording sheet.

According to the above configuration, the double-face printing operation may be continued with the newly fed recording sheet, which is fed from the sheet cassette 91/92. Therefore, even after the double-face printing operation with the preceding recording sheet is aborted, the images can be achieved by the newly fed recording sheet.

According to the above configuration, the preceding recording sheet may be avoided from being forcibly discharged when, for example, the manually-inserted recording sheet is detected by the pre-register sensor 63 but removed by the user immediately thereafter.

According to the above configuration, the reverse-conveyance of the preceding recording sheet may be cancelled even after the preceding recording sheet started being reversed. Thus, the preceding recording sheet may be effectively discharged, and concern for the collision between the preceding recording sheet and the manually-inserted recording sheet may be cleared.

According to the above configuration, the user may select a preferable action after ejection of the preceding recording sheet, and usability of the printer 100 may be improved.

Although an example of carrying out the invention have been described, those skilled in the art will appreciate that there are numerous variations and permutations of the printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the present invention can be similarly effectively applied to other image forming apparatuses having a double-face printing system and a manual sheet-feeding mechanism such as a copier, a multifunction peripheral device, and a facsimile machine. Further, the image forming unit in the image forming apparatus may not necessarily form images electro-photographically, but may form in, for example, inkjets. Furthermore, the image forming apparatus may be either a multi-color image forming apparatus or a monochrome image forming apparatus.

For another example, the printer 100 may be equipped with a conveying system, such as conveyer rollers, to assist inserting the recording sheet in the manual sheet path 17 in order for the manually-inserted recording sheet to be forwarded in the manual sheet path 17 smoothly.

For another example, the merging point 18, at which the manual sheet path 17 merges into the feeding path 11, may not necessarily be arranged in the downstream position with respect to the merging point 16, at which the reversing path 13 merges into the feeding path 11 but may be arranged in an upstream position with respect to the merging point 16.

Further, the pre-register sensor 63 may not necessarily serve to detect the manually-inserted recording sheet directed in the manual sheet path 17, but a sheet sensor to specifically detect the manually-inserted recording sheet in the manual sheet path 17 may be provided. With the specifically dedicated sheet sensor, the manually-inserted recording sheet may be detected earlier than the pre-register sensor 63. Furthermore, with the specific sheet sensor, the manually-inserted recording sheet may be detected whilst the printer 100 waits for the preceding recording sheet to pass by the register roller 73 in S104 (FIG. 4). When the manually-inserted recording sheet is detected by the specific sheet sensor, conveyance of the recording sheets may be error-terminated.

Furthermore, the reverse cancellable point may not necessarily be arranged in the position in the vicinity of the conveyer roller 77 but may be, for example, arranged in a position, in which the rear end of the preceding recording sheet is released from the discharge roller 76. Once the recording sheet is released from the discharge roller 76, which is rotatable in the normal and reverse directions, the recording sheet becomes no longer conveyable in the reverse direction. Therefore, the recording sheet reaching the reverse cancellable point may be determined when a predetermined time period elapses after the sheet sensor 67 detected the rear end of the recording sheet.

Figure 5:
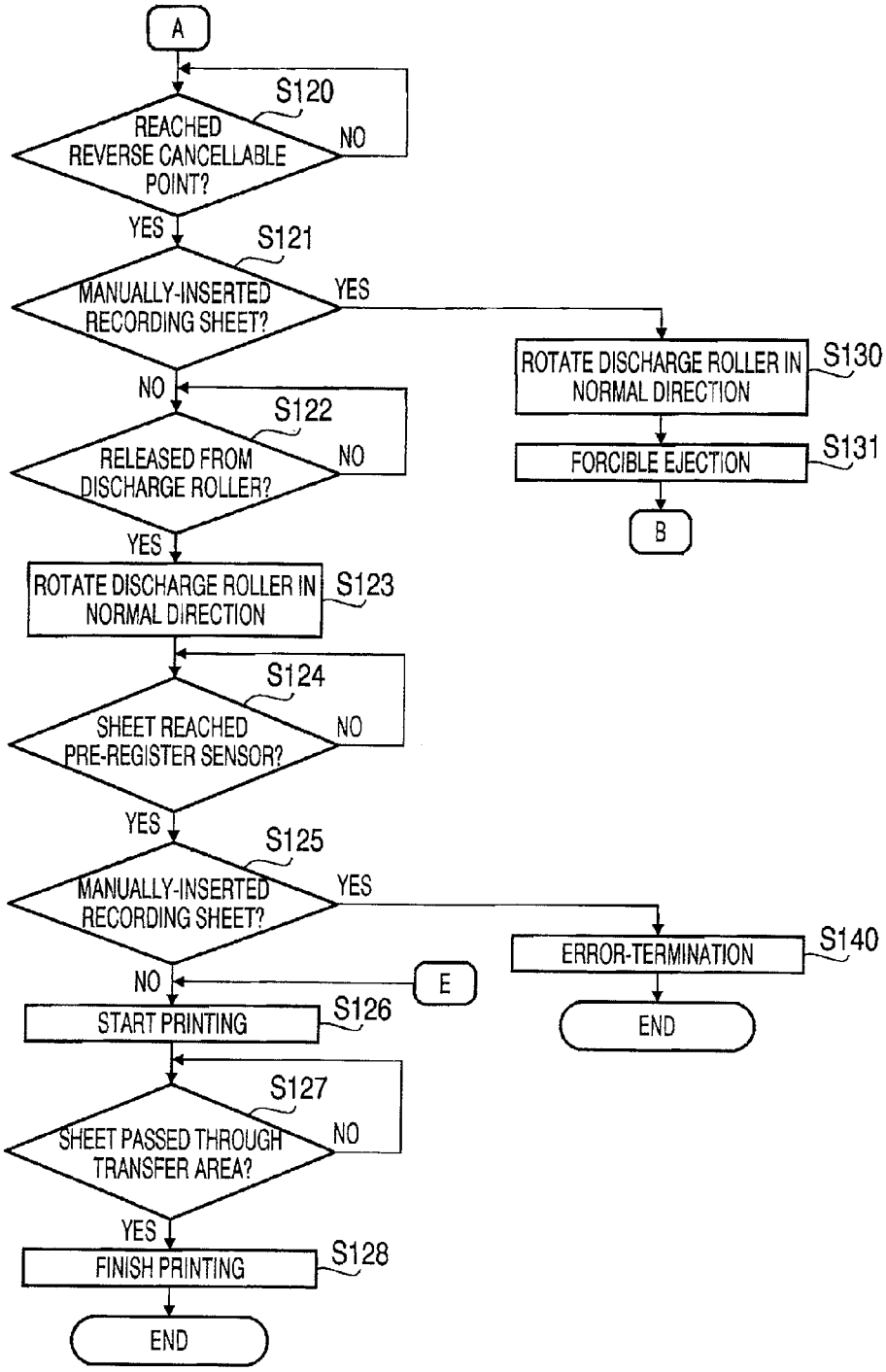
FIG. 5 is a second part of the flow of the double-face printing operation to be conducted in the printer according to the embodiment of the present invention.

For another example, during the printing operation to print an image on the first side of the recording sheet, judgment to determine presence of the manually-inserted sheet is performed when the recording sheet reaches the predetermined positions, e.g., the reversible position (FIG. 4, S107) and the reverse cancellable position (FIG. 5, S120). However, the judgment may not necessarily be triggered by the recording sheet reaching the reversible position or the reverse cancellable position but may be made whenever the pre-register sensor 63 detects the manually-inserted recording sheet. In such a case, the preceding recording sheet may be forcibly ejected and the continuing action may be executed immediately after detection of the manually-inserted sheet. Further, the double-face printing operation may be aborted even before the first image is printed on the first side of the preceding recording sheet or whilst the first image is being printed on the first side of the preceding recording sheet. On the other hand, if the judgment is to be made when the recording sheet reaches the predetermined position, when the user removes the manually-inserted recording sheet immediately after the insertion, necessity to forcibly eject the preceding recording sheet and executing the continuing action is cleared, and the double-face printing operation may be continued. Therefore, productivity of the printer 100 can be maintained.

According to the embodiment described above, when the manual double-face printing is selected as the continuing action (FIG. 6, S156: YES), the forcibly-ejected preceding recording sheet is inserted through the manual sheet inlet 93. However, the forcibly-ejected preceding recording sheet may be set in the sheet cassette 91/92 and conveyed in the main unit 10 therefrom. In this case, if an unused recording sheet remains in the sheet cassette 91/92, the unused recording sheet may be picked up earlier before the forcibly-ejected preceding recording sheet is set in the sheet cassette 91/92. Therefore, in order to avoid the unused recording sheet in the sheet cassette 91/92 from being picked up instead of the forcibly-ejected preceding recording sheet, the feed roller 71/72 may be manipulated to be activated after the forcibly-ejected preceding recording sheet is settled in the sheet cassette 91/92, and a specific instruction from the user to start picking up the forcibly-ejected preceding recording sheet is entered.

In the embodiment described above, when the user selects to retry the double-face printing operation with a new recording sheet (FIG. 6, S154: YES) or to continue the double-face printing operation with the forcibly-ejected preceding recording sheet (FIG. 6, S156: YES), the flow waits for the manually-inserted recording sheet being nipped by the register roller 73 to be removed by the user. However, the flow may not necessarily wait for the manually-inserted recording sheet to be removed by the user, but the manually-inserted recording sheet may be drawn in and through the main unit 10 and directed along the printing path 14 to be forcibly ejected out of the printer 100 without having any image printed on a surface thereof.

For another example, the printer 100 may not necessarily convey a single recording sheet at a time to print the first image on the first side and the second image on the second side sequentially. A plurality of (e.g., two) recording sheets may be in the printer 100 at a time, and a first image may be printed on a first side of a succeeding recording sheet in the printing path 14 whilst a preceding recording sheet with a first image printed on a first side thereof is in the reversing path 13. In other words, first images may be printed sequentially on first sides of a plurality of recording sheets. In the printer 100 configured as above, the succeeding recording sheet may not necessarily wait for the preceding recording sheet to be ejected but may be efficiently fed in the printing path 14 before the preceding recording sheet is ejected. In other words, the recording sheets may be fed in shorter intervals, and productivity of the printer 100 can be improved.

Figure 9:
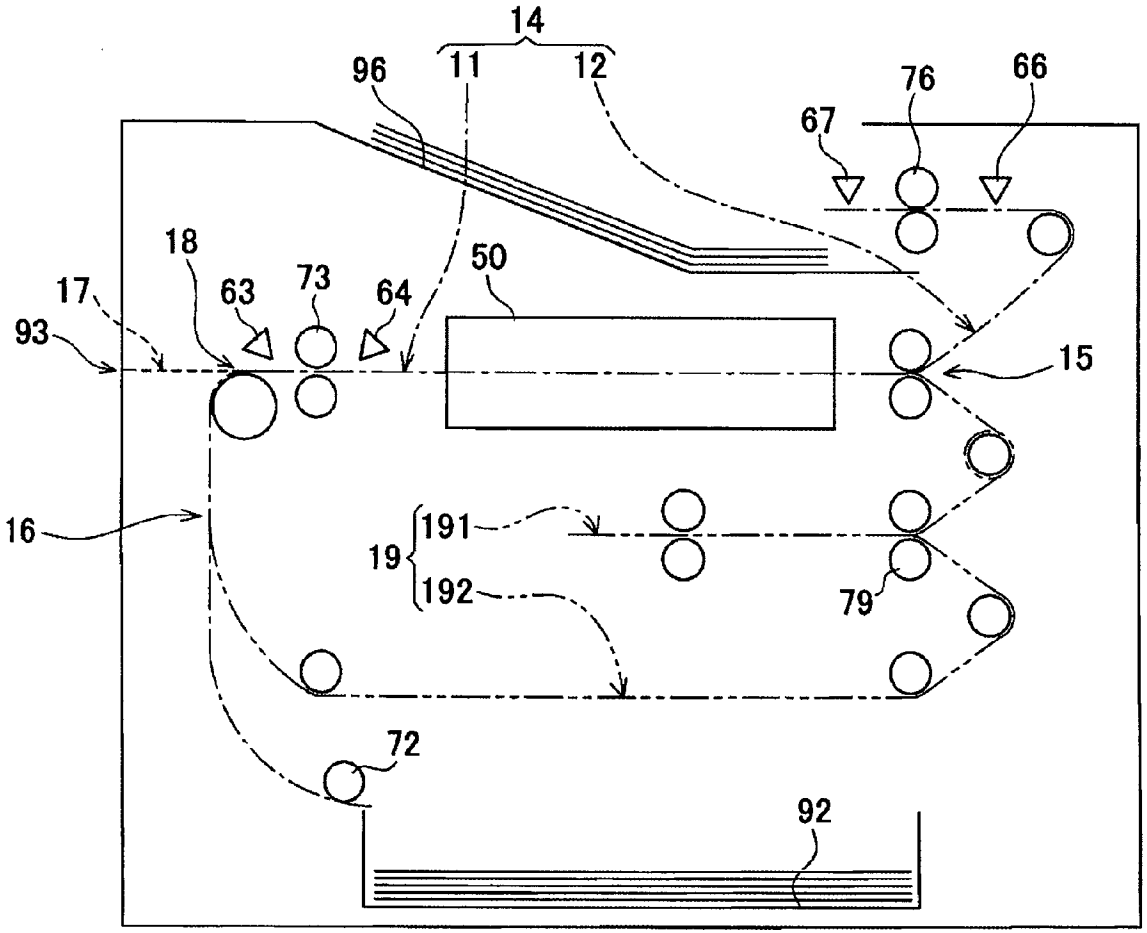
FIG. 9 is a schematic diagram to illustrate an internal configuration of another example of the printer according to the embodiment of the present invention.

Further, the discharge roller 76 may not necessarily serve to reverse the recording sheet, but a specific reversing roller 79 (see FIG. 9) may be provided. For example, as shown in FIG. 9, the reversing path 19 may have a switchback path 191, in which the recording sheet is turned over, and a returning path 192, along which the recording sheet turned over in the switchback path 191 is guided to the feeding path 11. In a double-face printing operation, the recording sheet with the first image printed on the first side is carried in the switchback path 191 via the branch point 15. In this regard, the reversing roller 79 rotates in a normal direction. When the recording sheet is carried in the switchback path 191 with its rear end portion nipped by the reversing roller 79, rotation of the reversing roller 79 is switched to a reverse direction. According to the reverse rotation, the recording sheet is guided in the returning path 192 and returns to the feeding path 11 via the merging point 16. In this regard, the second side of the recording sheet comes to face the processing unit 50 to have the second image printed thereon.

With this reversing configuration shown in FIG. 9, the discharge roller 76 may not necessarily be rotatable in the normal and reverse directions but may be rotatable solely in the normal direction. According to such configuration, the recording sheet starts to be reversed at the branch point 15, at which the discharge path 12 and the reversing path 19 diverge. Further, according to the above-described configuration, once the preceding recording sheet enters the reversing path 19, it may be difficult to switch conveying directions; therefore, steps S109 and S120-S123 should be omitted. In this configuration, when no manually-inserted recording sheet is detected in S108 (S108: NO), the flow should proceed to S124.

What is claimed is:

1. A printing apparatus, which is capable of double-face printing to print images on both sides of a recording sheet, comprising:

a printing unit, which is configured to print an image on one of the sides of the recording sheet;

a sheet feeder, which is configured to feed the recording sheet to the printing unit;

a discharge unit configured to receive settlement of the recording sheet with the image printed thereon;

a sheet path, which includes a feeding path to guide the recording sheet fed from the sheet feeder to the printing unit, a discharge path to guide the recording sheet passing through the printing unit to the discharge unit, and a reversing path diverging from the discharge path and merging into the feeding path at an upstream position with respect to the printing unit along a direction of conveying the recording sheet, the sheet path guiding the recording sheet therealong and reversing the recording sheet by use of the reversing path and reverse-conveyance during a double-face printing operation;

a manual sheet inlet, configured to receive manual insertion, by a user, of a recording sheet into the printing apparatus;

a manual sheet path, which is configured to merge into the sheet path at a merging point, the merging point being at an upstream position with respect to the printing unit along the direction of conveying the recording sheet and guide the manually-inserted recording sheet to the merging point;

a processor; and memory storing instructions that, when executed, cause the printing apparatus to function as:

a detecting unit, which is configured to detect the manually-inserted recording sheet fed through the manual sheet inlet;

a judging unit, which is configured to judge whether the detecting unit detects the manually-inserted recording sheet while the double-face printing operation is conducted with a preceding recording sheet; and a conveyer controller unit, which is configured to convey the preceding recording sheet in the double-face printing operation to the discharge unit without reversing when the judging unit judges that the detecting unit detected the manually-inserted recording sheet.

2. The printing apparatus according to claim 1, wherein the instructions, when executed, further cause the printing apparatus to function as:

a print controller unit, which is configured to manipulate the printing unit to print an image, which was to be printed on one of the sides the preceding recording sheet, on a recording sheet fed through the manual sheet inlet after the preceding recording sheet is conveyed to the discharge unit.

3. The printing apparatus according to claim 2, wherein the printing unit is configured to complete printing the image on the one of the sides of the preceding recording sheet before the preceding recording sheet is conveyed to the discharge unit;

wherein the print controller unit manipulates the printing unit to print the image, which was to be printed on another side of the preceding recording sheet, on the other side of the preceding recording sheet fed through the manual sheet inlet once the preceding recording sheet is conveyed to the discharge unit.

4. The printing apparatus according to claim 2, wherein the print controller unit is configured to manipulate the printing unit to print the images, which were to be printed on both sides of the preceding recording sheet, on both sides of the manually-inserted recording sheet detected by the detecting unit after the preceding recording sheet is conveyed to the discharge unit.

5. The printing apparatus according to claim 1, wherein the instructions, when executed, further cause the printing apparatus to function as:

a print controller unit, which is configured to manipulate the printing unit to print the images, which were to be printed on both sides of the preceding recording sheet, on both sides of a recording sheet newly fed by the sheet feeder after the preceding recording sheet is conveyed to the discharge unit.

6. The printing apparatus according to claim 1, wherein the judging unit is configured to judge whether the detecting unit detected the manually-inserted recording sheet after the preceding recording passes through the printing unit and before the preceding recording sheet starts being reversed.

7. The printing apparatus according to claim 1, wherein the judging unit is configured to judge whether the detecting unit detected the manually-inserted recording sheet after the preceding recording sheet started being reversed; and wherein, when the judging unit judges that the detecting unit detected the manually-inserted recording sheet after the preceding recording sheet started being reversed, the conveyer controller unit judges whether reverse-conveyance of the preceding recording sheet is cancellable, and, when it is judged that the reverse-conveyance of the preceding recording sheet is cancellable, cancels the reverse-conveyance of the preceding recording sheet and conveys the preceding recording sheet to the discharge unit.

8. The printing apparatus according to claim 5, further comprising:

a unidirectional conveyer roller, which is arranged in the reversing path and configured to rotate in one direction to forward the recording sheet in the sheet path, wherein the conveyer controller unit is configured to judge that the reverse-conveyance of the preceding recording sheet is cancellable until the preceding recording sheet, which has started being reversed, reaches the unidirectional conveyer roller and to judge that the reverse-conveyance of the preceding recording sheet is non-cancellable once the preceding recording sheet has reached the unidirectional conveyer roller.

9. The printing apparatus according to claim 5, further comprising:

a bidirectional conveyer roller, which is arranged in the discharge path and configured to rotate in two directions to forward and reverse the recording sheet in the sheet path, wherein the conveyer controller unit is configured to judge that the reverse-conveyance of the preceding recording sheet is cancellable while the preceding recording sheet, which has started being reversed, is nipped by the bidirectional conveyer roller and to judge that the reverse-conveyance of the preceding recording sheet is non-cancellable once the preceding recording sheet is released from the bidirectional conveyer roller.

10. The printing apparatus according to claim 1, further comprising:

a selection entering unit, configured to receive user selection of a continuing action amongst at least two options out of a plurality of options, wherein the continuing action is to be conducted after completion of conveyance of the preceding recording sheet to the discharge unit;

wherein the plurality of options for the continuing action includes:

conducting the double-face printing operation to print the images, which were to be printed on both sides of the preceding recording sheet, on both sides of a new recording sheet to be fed by the sheet feeder;

conducting the double-face printing operation to print the images, which were to be printed on both sides of the preceding recording sheet, on both sides of the manually-inserted recording sheet;

continuing the double-face printing operation to print the image, which was to be printed on one of the sides of the preceding recording sheet, on the one of sides of the preceding recording sheet; and canceling the double-face printing operation.

11. A printing apparatus, which is capable of double-face printing to print images on both sides of a recording sheet, comprising:

a sheet storage configured to store a recording sheet;

a printing unit configured to print an image on one of the sides of the recording sheet;

a discharge tray configured to receive the recording sheet with the image printed thereon;

a conveyer including:

a feeding unit configured to feed the recording sheet from the sheet storage to the printing unit, a discharging unit configured to discharge the recording sheet passing through the printing unit to the discharge tray, and a reversing unit configured to feed the recording sheet passing through the printing unit to an upstream position with respect to the printing unit with reversing while conducting a double-face printing operation;

a manual sheet inlet, through which a recording sheet is manually inserted in the printing apparatus;

a detector configured to detect a recording sheet feed through the manual sheet inlet;

a processor; and a memory storing instructions that, when executed by the processor, cause the printing apparatus to:

judge whether the detector detects that another recording sheet is inserted to the manual sheet inlet while the double-face printing operation is being conducted with a preceding recording sheet;

control the conveyer to convey the preceding recording sheet in the double-face printing operation to the discharge tray without reversing when the detector detects that another recording sheet is inserted to the manual sheet inlet while the double-face printing operation is being conducted with the preceding recording sheet; and control the conveyer to convey the preceding recording sheet in the double-face printing operation to the printing unit with reversing when the detector does not detect that another recording sheet is inserted to the manual sheet inlet while the double-face printing operation is conducting with the preceding recording sheet.

* * * * *